United States Patent [19]

Mefford

[11] 4,423,774

[45] Jan. 3, 1984

[54] METHOD AND APPARATUS FOR POSITIONING A SAFETY VALVE SUB FOR CONNECTION IN A THREADED TUBULAR MEMBER

[76] Inventor: Joe Mefford, 6042 Cheena, Houston, Tex. 77096

[21] Appl. No.: 270,020

[22] Filed: Jun. 3, 1981

[51] Int. Cl.[3] ..... E21B 17/02

[52] U.S. Cl. ..... 166/77.5; 166/78; 166/92; 166/379; 285/18; 285/283; 285/DIG. 13

[58] Field of Search ..... 166/369, 364, 77.5, 166/78, 92, 93, 379, 380; 285/DIG. 13, 283, 18; 175/218; 173/164, 32, 33

[56] References Cited

U.S. PATENT DOCUMENTS

| | | | |
|---|---|---|---|
| 1,240,778 | 9/1917 | Podobiedoff | 166/93 |
| 2,125,762 | 8/1938 | Wheeler . | |
| 3,282,339 | 11/1966 | Hasha | 166/77.5 |
| 3,319,979 | 5/1967 | Herold et al. | 285/283 |
| 3,625,282 | 12/1971 | Bridges | 285/283 |
| 3,768,579 | 10/1973 | Klein | 173/164 |
| 3,887,161 | 6/1975 | Kubelka | 251/58 |
| 3,915,244 | 10/1975 | Brown | 166/77.5 |
| 3,971,442 | 7/1976 | Scott | 166/380 |
| 4,026,354 | 5/1977 | Burrow | 285/DIG. 13 |
| 4,323,221 | 4/1982 | Kroher et al. | 175/218 |

*Primary Examiner*—William F. Pate, III
*Attorney, Agent, or Firm*—Jack W. Hayden

[57] ABSTRACT

First means are provided which removably engage an upwardly extending tubular member. Support means for the safety valve sub are pivotally connected to the first means. Means are provided to secure the support means and the first means in axial alignment when the support means is tiltably moved to such position and rotatable means are carried by the support means to rotate the safety valve sub to connect it with an upwardly extending tubular member.

11 Claims, 17 Drawing Figures

METHOD AND APPARATUS FOR POSITIONING A SAFETY VALVE SUB FOR CONNECTION IN A THREADED TUBULAR MEMBER

SUMMARY OF THE INVENTION

In normal rotary oil and gas well drilling operations, a rotary table is supported adjacent the drilling mast work floor and enables rotation to be imparted to a noncircular member, called a kelly, extending therethrough and which in turn is connected to the drill string whereby the drill string is rotated during drilling operations. Connected at the upper end of the kelly is a shorter tubular member normally termed, a kelly valve sub or kelly valve saver sub, which includes a valve that may be moved to closed position to close off flow through the kelly valve sub, connected kelly and drill string therebeneath when desired. A swivel rotatably supports the upper end of the kelly saver sub and includes a gooseneck whereby drilling fluids may be supplied through the swivel to the rotating kelly saver sub, kelly and drill string during normal drilling operations in a manner well known in the art.

When the drill string is to be removed from the well bore for the replacement of the drilling bit, or to carry out other desired operations, the traveling block, which supports the swivel may be activated as well known to raise the swivel, kelly and connected drill string so that the drill string is positioned above the rotary table. Slips are then positioned in the rotary table bowl to engage the drill string and support it so that its upper end is above the rotary table. The noncircular kelly is disconnected or unthreaded from the drill string by tongs or other means well known in the art. The swivel, kelly saver sub connected therewith and kelly are then positioned as understood by those skilled in the art away from the rotary table in a receptacle normally termed a "rathole" which is a tubular member positioned to extend downwardly from the floor of the drilling mast and is of sufficient diameter to receive the noncircular kelly therein.

If it is then desired to withdraw the drill string from the well bore, elevators supported by the traveling block are engaged with the upstanding portion of the drill string above the rotary table and lifted upwardly into the mast until the next joint is exposed above the rotary table, whereupon the slips are then again positioned in the rotary table and this section or joint of drill string threadedly disengaged by tongs or the like. In some instances a single joint of pipe is disconnected, but in most instances, three or four lengths of pipe, normally termed "trebles" or "fourbles" are pulled upwardly and then disengaged from the drill string as above described in order to expedite removal of the drill string from the well bore, as well as expediting re-entry of the drill string into the well bore when desired. As the sections of drill string are disconnected, they are either stacked on a drill pipe rack adjacent the mast, or they are left standing on the floor of the mast or on a structure adjacent thereto sometimes referred to as a set back tower.

The removal of the drill string from the well bore may be a dangerous operation, and it is not uncommon for well blowouts to occur particularly during such withdrawal of the drill string from the well bore. A device termed a blowout preventor may normally be positioned beneath the drilling mast working floor which can be actuated to close off around the drill pipe and prevent flow of fluids between the drill pipe and the surrounding bore annulus.

Various devices and arrangements have been provided to attempt closing off the interior of the drill string should a blowout occur as the well string is either removed from or run back into the well bore to thus prevent well fluids from passing upwardly through the interior of the drill string. It can be appreciated that as the drill string is being withdrawn from the well bore, no valve means are connected therewith. Normally there is a safety valve on the floor during these operations for placement on the open end of the drill pipe manually when desired. However, this valve is of considerable weight, making it difficult to manipulate into position. Also, since drilling mud has generally escaped onto the floor of the drilling rig, it is generally slick therefrom making the safety valve even more difficult to handle. In addition, if a mud flow is being experienced when it is desired to position the valve this causes greater difficulty in that the mud flow will enter the workers eyes and onto his face and body.

Also, the upper end of the drill string may be anywhere from a few feet to as much as 120 feet above the rig floor when a blowout occurs, depending upon the number of sections of pipe being removed from or run into the well bore.

Heretofore, this closure has in some instance been effected by a worker climbing the rig with a kelly valve sub and then endeavoring to thread such kelly valve sub into the upper end of the pipe above the drilling mast floor. This may be extremely dangerous and is difficult particularly if fluid is flowing out the upper end of the drill string which makes it more difficult to engage the threaded end of the kelly valve sub with the drill string. Thus, should internal pressure in the well bore cause fluids to move upwardly, it can be appreciated that a great deal of difficulty is encountered in positioning some type of closure means on the upper end of the drill string to prevent flow of fluid therefrom.

Other arrangements have been provided such as that shown in U.S. Pat. No. 3,887,161, which provides a power means for operating the valve in the upper kelly valve as kelly cock. However, it can be appreciated that where this arrangement is to be employed, it would be first necessary to set the slips in the bowl, disengage the elevators from the upper end of the drill string in the drilling mast, then engage the swivel which is positioned to the side of the drilling mast floor at the top of the "rathole", draw it from the "rathole", and then engage it into the drilling string or well string before such power means can be actuated.

If a well is experiencing pressure surges or indicates that it is going to blow, it can be appreciated that time is of the essence and a matter of seconds or minutes can become extremely important.

A primary object of the present invention is to provide a well tool to position a safety valve sub so that it may be connected in the upwardly extending tubular member above the rotary with a minimum of effort so that the safety valve may be closed to close off the interior of the drill string or well string.

A primary object of the present invention is to provide a well tool to position a safety valve sub so that it may be connected in the upwardly extending tubular member above the rotary with a minimum of effort so that the valve may be closed to close off the interior of the drill string or well string.

A primary object of the present invention is to provide a well tool to position a safety valve sub so that it may be connected in the upwardly extending tubular member above the rotary with a minimum of effort, and which well tool may be disengaged and removed from the safety valve sub after the sub is threadedly engaged with the upwardly extending tubular member.

Yet a further object of the present invention is to provide means which may be removably engaged or latched about an upwardly extending tubular member, with support means for a safety valve pivotally connected thereto and which support means may be axially aligned with the means that removably engage or latch about the tubular member and power means for rotating the safety valve carried by the support means so that the safety valve may be threadedly engaged with the upstanding tubular member.

Still another object of the present invention is to provide a method for positioning a safety valve sub for connection in a tubular member to enable the valve to be closed to prevent flow through the interior of the tubular member.

Other objects and advantages of the present invention will become more readily apparent from consideration of the following drawings and descriptions.

DESCRIPTION OF THE PREFERRED EMBODIMENTS

Figure 17:
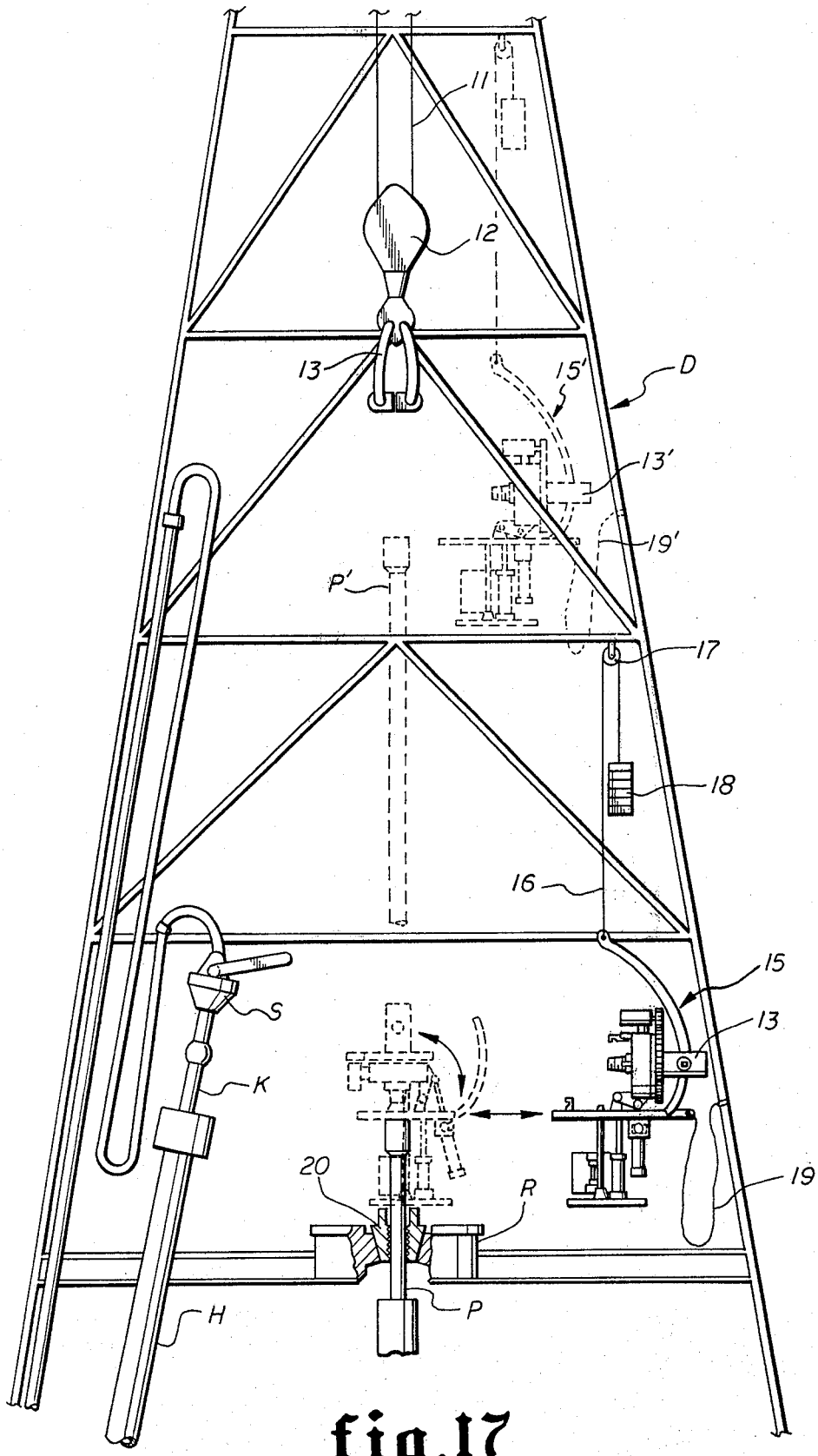
FIG. 17 is a schematic view illustrating in solid line the position of the present invention it may assume during normal drilling operations and showing it in dotted line positioned on the upstanding tubular member ready for use. Such Fig. also illustrates the traveling block and the elevator connected therewith. The swivel, kelly saver sub connected therewith and noncircular kelly are shown positioned in the "rathole".

Attention is first directed to FIG. 17 of the drawings wherein a drilling mast is referred to generally by the letter D. A plurality of cables as illustrated at 11 extend downwardly from the crown block (not shown) at the top of the drilling mast D to support the traveling block 12 for vertical movement in the drilling mast D in a manner well known in the art. The traveling block 12' is shown as being provided with what are termed elevators 13 to enable the pipe P to be engaged and removed from the drill string, or which elevators 13 may be engaged with pipe on a pipe rack or on a set-back tower and lowered into position for connection in the well string and the well string relowered into the well bore. For purposes of explanation only, the present invention will be described in detail when the pipe P is to be removed from the well bore.

As can be seen in FIG. 17, the "rathole" H extends at an angle and is positioned away from the rotary table R and during the operations described in connection with the present invention, the swivel S with the kelly saver sub K, kelly cock and kelly (not shown) are positioned in the "rathole" H and out of the way as the pipe P is removed from or run into the well bore.

Figure 15:
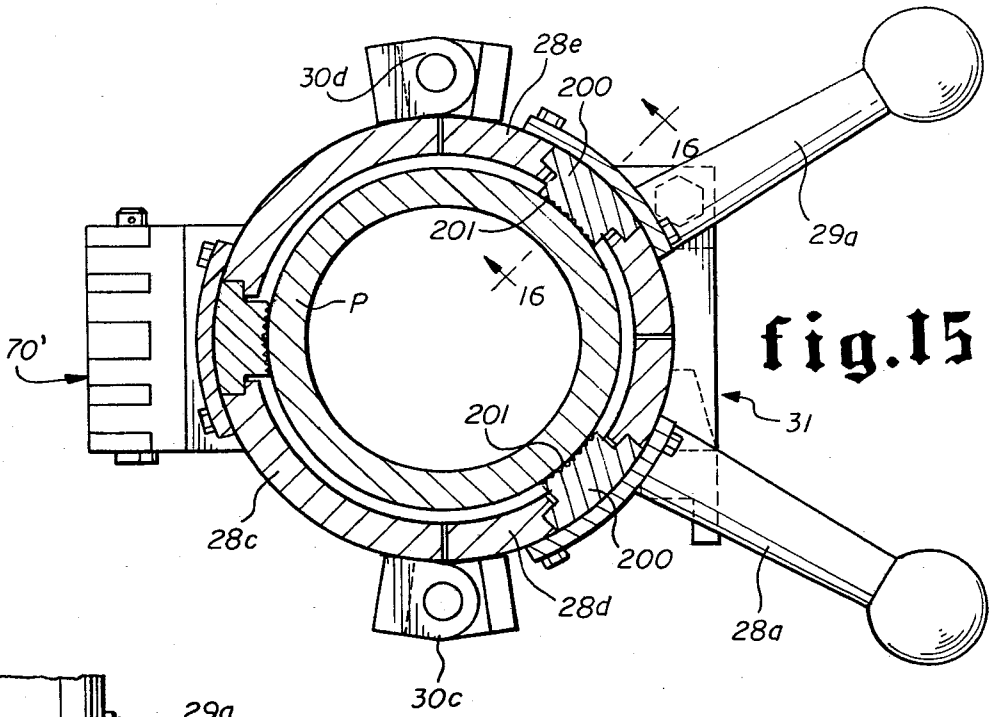
FIG. 15 is a sectional view on the line 15—15 of FIG. 13 showing the latch means for securing the device on the upstanding tubular member to enable the valve sub to be threadedly engaged with the tubular member and one form of back-up means.
Figure 16:
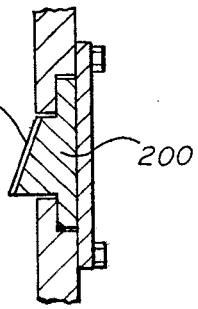
FIG. 16 is a sectional view on the line 16—16 of FIG. 15.
Figure 14:
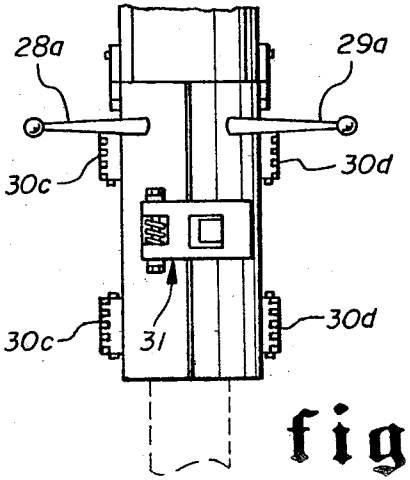
FIG. 14 is a side view on the line 14—14 of FIG. 13.

Generally speaking, the present invention referred to by the numeral 15 is shown as being supported adjacent one side of the drilling mast D and out of the way during normal drilling operations. Such support may assume any suitable configuration and, as illustrated, includes cable means 16 extending over a sheave 17, and which cable means 16 is provided with a counterbalance or counterweight 18 as shown. A tie-back line 19 is connected to the drilling mast D and is positioned at any suitable point on the present invention to hold it against rotation as rotation is imparted to connect the safety valve sub carried by the present invention into the upper end of the pipe P. FIGS. 15 and 16 illustrate another arrangement which may be employed in lieu of the tie-back line 19, as will be described.

In FIG. 17, one form of the invention 15 is shown in dotted line as being latched on the upper end of the pipe P which extends upwardly above the rotary table R as illustrated, and which pipe P is held in such position in the rotary table by the slips 20.

The embodiment of the well tool 15 illustrated in FIG. 17 is shown in FIGS. 1 through 6 of the drawings in greater detail, and is again referred to by the numeral 15.

Figure 2:
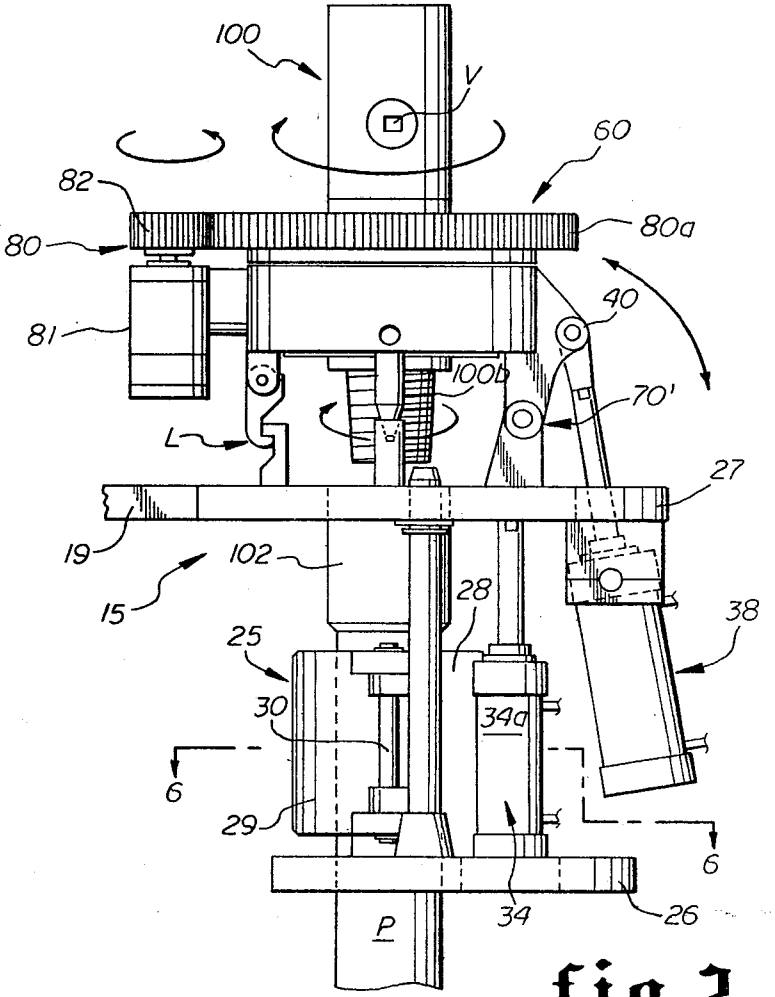
FIG. 2 is a view similar to FIG. 1 but illustrating the relationship of the components immediately prior to rotating the safety valve sub to connect it into the upwardly extending tubular member.
Figure 1:
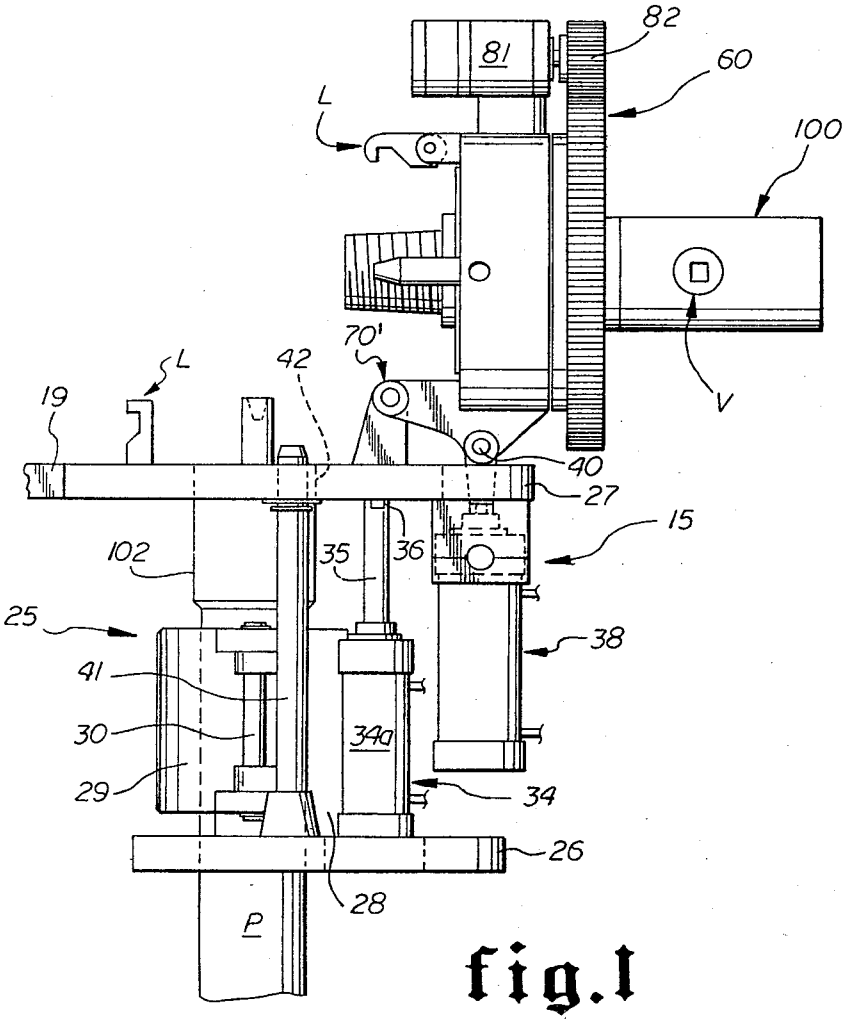
FIG. 1 is a side view of one form of the invention.
Figures 3, 4, 5, 6:
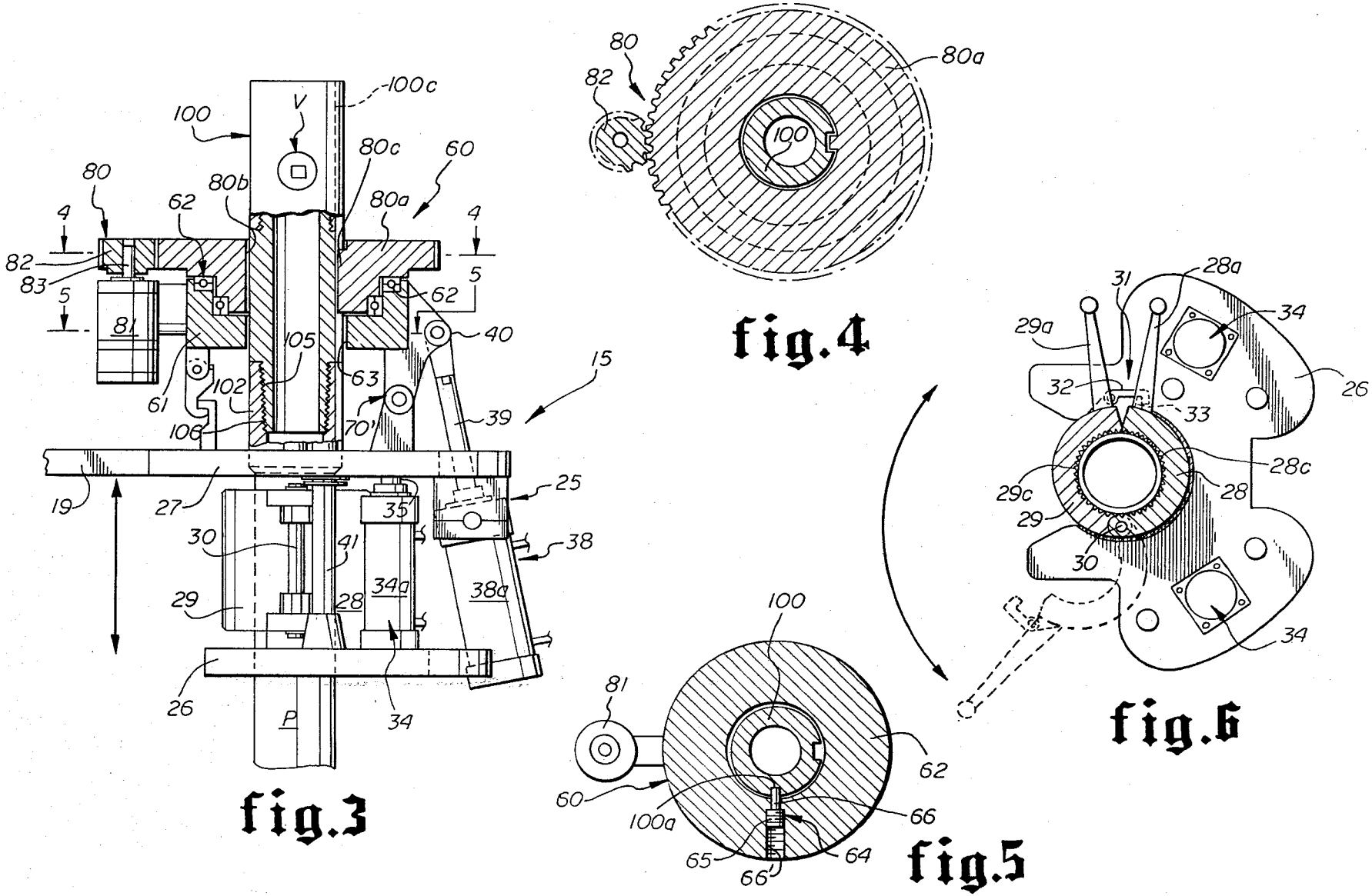
FIG. 3 is a perspective view similar to FIGS. 1 and 2 and illustrative of the relationship of the components when the safety valve sub has been threaded into the upstanding tubular member.
FIG. 4 is a sectional view on the line 4—4 of FIG. 3 showing one form of driving coupling or connection between the safety valve sub and means to rotate it.
FIG. 5 is a sectional view on the line 5—5 of FIG. 3 and illustrating a retaining means to retain the safety valve sub in position as the components of the device are aligned for connection of the safety valve sub into the upstanding tubular member.
FIG. 6 is a sectional view on the line 6—6 of FIG. 2 and illustrates the first means for engaging about the upper end of the upwardly extending tubular member with latch means for retaining such first means in position during operation of the well tool.
Figure 7:
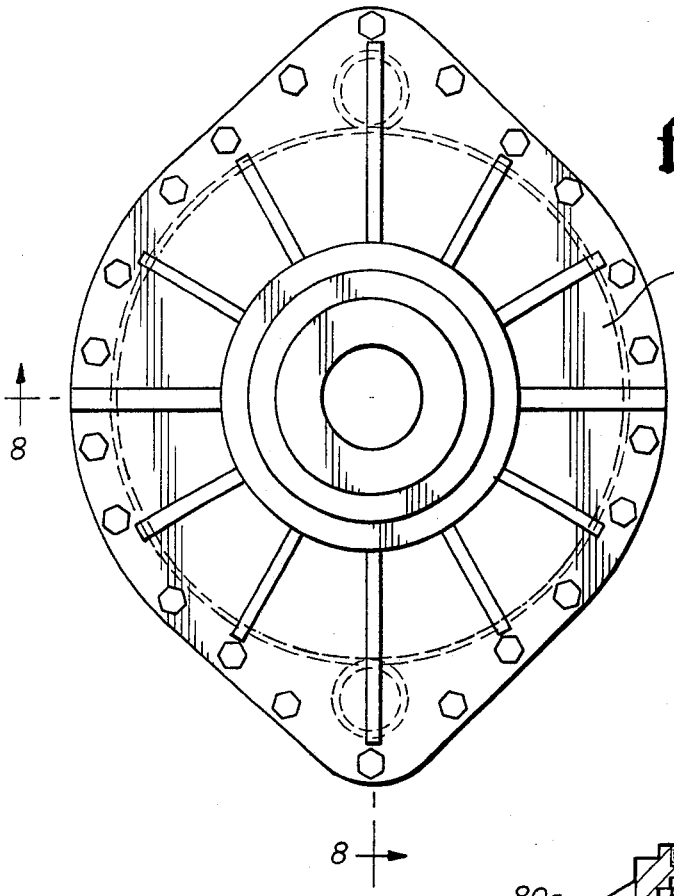
FIG. 7 is a top plan view of the device shown in FIG. 8.
Figure 9:
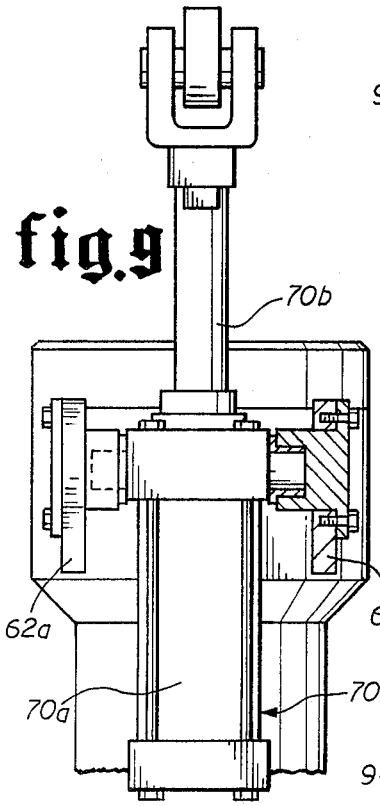
FIG. 9 is a view, partly in section on the line 9—9 of FIG. 8.

Such embodiment illustrates a first means, generally referred to as 25, for engaging on the pipe P as illustrated in FIGS. 1–3, inclusive. Second means referred to generally at 60 are pivotally connected as illustrated at 70' to the first means 25 and form or provide a support means for a safety valve sub referred to by the numeral 100. Suitable cooperating latch means referred at L are provided on the first means 25 and the second or support means 60 to secure the support means 60 and the first means of 25 in axial alignment on the tubular member P as illustrated in FIG. 2 of the drawings. When the device 15 is positioned as shown in FIG. 2 of the drawings, rotatable means referred to by the numeral 80 may be actuated by any suitable air, hydraulic power or other power source 81 for imparting rotation to the safety valve sub 100 to engage it with the threaded box end 102 of the pipe P.

The first means 25 of the FIGS. 1–6 form includes first and second plates 26 and 27 which are vertically spaced as illustrated in FIGS. 1, 2 and 3. A first semicircular member 28 is secured at one end to the first plate 26 and extends upwardly therefrom as shown in FIG. 1, 2, 3 and 6. A second semicircular member 29 is hingedly connected to the first semicircular member 28 by the hinge and pin as shown at 30 and is free to pivot about such pin relative to the plates 26, 27 and the semicircular member 28. Handles **28*a* and 29*a* are connected to each semicircular member 28 and 29, respectively, as illustrated in the drawing to enable the device of the present invention to be moved into position adjacent the upper end of the pipe P and immediately below the box end 102 thereof so that the well tool 15 of the present invention may be secured in position on the upstanding tubular member or pipe P. The semicircular members 28 and 29 also include cooperating latch means referred to generally at 31 which include a spring-urged arm 32 and a catch 33 so that when the semicircular member 29 is closed about the pipe P, the latch means 31 will engage and releasably retain the first means 25 as well as means 60 pivotally supported thereby in position on the upper end of the tubular member P. It can be appreciated, of course, that at such time the device is held in general upright position by means of the cable 16 described with regard to FIG. 16** of the drawings.

It can also be seen that each of the semicircular members 28 and 29 are provided with serrated annular inner surfaces **28*c* and 29*c*, respectively, for gripping the exterior surface of the tubular member P to assist in preventing relative rotation between the pipe P and well tool 15 as the safety valve sub 100 is rotated to threadedly engage with the box 102** on the upper end of the tubular member P.

In addition, suitable power means referred to generally at 34 are provided for moving the first and second vertically plate members 26 and 27 longitudinally relative to each other when desired. Such power means may be in the form of a double-acting piston and cylinder arrangement including cylinder means **34*a* which receives suitable piston means (not shown) therein to which is connected rod piston 35 which extends from the cylinder 34*a* and is connected as shown at 36 to the second plate 27 so that the plates 26, 27** may be moved toward and away from each other as desired.

The first means 25 also includes the power means referred to generally at 38 which may be employed, if desired, to swing or pivot the second means or support 60 into axial alignment with the first means 25 to assume the position shown in FIG. 2 of the drawings. Such power means may be of any suitable type and, as illustrated, includes a hydraulic double-acting cylinder **38*a* which is provided with a piston (not shown) and a piston rod 39 connected to the piston and extending from the cylinder 38*a* as shown to be pivotally connected at 40 adjacent one edge of the support means 60. Thus, if desired, the power means 38 may be employed to swing or pivot the support means 60 from the retracted position shown in FIG. 1 to the aligned position shown in FIG. 2**.

When the second means or support means 60 is swung from the position of FIG. 1 to the position of FIG. 2, the latch means L cooperate to engage and thus axially align the first means 25 and the second means or support means 60 as shown in FIG. 2 of the drawings.

Suitable guide rods 41 are mounted on the first plate 26 and are of suitable extent to extend through the holes 42 in the second plate 27 to guide and maintain plates 26 and 27 in the proper position as the safety valve sub is threadedly connected into the tubular member P.

The rotatable means or means to rotate 80 includes a ring gear **80*a* rotatably carried by the second or support means 60. The pneumatic or hydraulic motor means 81 includes a gear 82 on its shaft for imparting rotation to ring gear 80*a* in either direction. The support means 60 includes a housing 61 provided with bearing means 62 to accommodate relative rotation between the ring gear 80*a* and the housing 61 as shown in greater detail in FIG. 3 of the drawings. It will be noted that the safety valve sub 100 extends through a central opening 80*b* provided in ring gear 80*a* and a central opening 63 provided in the housing 61. Suitable retaining means are provided to retain the safety valve sub 100 in position in the support or second means 60 as the means 60 is pivoted from the position of FIG. 1 to be axially aligned with the first means 25 as illustrated in FIG. 2 of the drawings. In the form shown in FIGS. 1–6, such retaining means is in the form of shear pin means 64 which includes a portion 65 threadedly engaged in the threaded open 66' in the housing 61 and with a projecting portion 66 thereof engaging in the recess 100*a* of the safety valve sub 100 as shown in greater detail in FIG. 5 of the drawings. This enables the safety valve sub to maintain its position in the housing 61 as the second means 60 is swung into alignment with the first means 25** and to prevent premature movement thereof that might interfere with proper operation of the device.

In the FIGS. 7–16 form, such retaining means may be the shear pin **79*a*, or the bladder 110*a***, or both, as will be described.

When the first means 25 and the support 60 are aligned as shown in FIG. 2 with the threaded pin end **100*b* of the safety valve sub 100 positioned adjacent the upper end 102 of the tubular member P, rotation of the ring gear 80*a* by means 81 will shear the pin 65 to enable the safety valve sub 100 to move, or drop, downwardly for threaded engagement with the box end 102 as the ring gear 80*a*** continues to rotate.

Suitable coupling means or drive means to couple the ring gear **80*a* with the safety valve sub 100 are provided and include a longitudinally extending groove or keyway means 100*c* formed in the safety valve sub 100 as better illustrated in FIG. 3. A key 80*c* is formed on the ring gear and projects into the central opening 80*b* to engage in the slot 100*c* of the safety valve sub 100 so that when the power means 81 is actuated the piston 82 connected on the shaft 83 of such power source will rotate and in turn cause rotation of the ring gear 80*a* and the safety valve sub 100. When such rotation occurs, the shear pin 64 shears, thus enabling the safety valve sub 100 to move downwardly into engagement with the box 102 of the upstanding pipe P. Continued rotation of the safety valve sub 100 will cause the threads 105 on the lower end of the safety valve sub to thread with the internal threads 106 on the box member 102. As previously noted, a tie-back means, or line 19 is connected to the device of the present invention to prevent rotation between pipe P and the well tool 15 when the well tool 15 is engaged on such pipe to enable the safety valve sub 100 to be threadedly connected. If desired, the segments 200 with serrations 201 shown in FIGS. 15 and 16 may be positioned in the semicircular portions 28, 29 to prevent rotation between pipe P and well tool 15 when the tool 15 is engaged on such pipe to enable the safety valve sub 100 to be threadedly connected. In such case, the line 19** may be omitted.

After the safety valve sub 100 has been threadedly connected into the pipe P as shown in FIG. 3, the safety valve represented at V therein may then be manually rotated to close off the interior of the pipe P to prevent discharge therefrom.

If it is desired to remove the well tool 15 of the present invention from the pipe P after the safety sub 100 has been connected therewith, the latch 31 on the first means 25 may be manually disenaged and semicircular members 28 and 29 thus opened to disenage the means 25 from the pipe P. Thereafter, the support means 60 and connected first means 25 may be moved up over the end of the safety valve sub 100 by moving the key 80*c* longitudinally in the slot 100*c* of the safety valve sub 100.

FIGS. 7–16 illustrate another and preferred embodiment of the present invention with like numerals identifying similar parts. As better seen in FIG. 15, first means 25 includes arcuate members 28*c*, 28*d* and 28*e* that are pivotally or hingedly connected together at 30*c*, and 30*d*. The arcuate portions are provided with segments 200 having serrated surfaces 201 for gripping the upper end of the pipe P as previously shown and described to prevent relative rotation between the pipe P and the device as it is rotated. Such arrangement also prevents backlash of the device as it is actuated. The arcuate portions 28*d* and 28*e* include handle means 28*a*, 29*a* as well as latch means 31 for automatically latching when engaged about the tubular member P.

Figure 13:
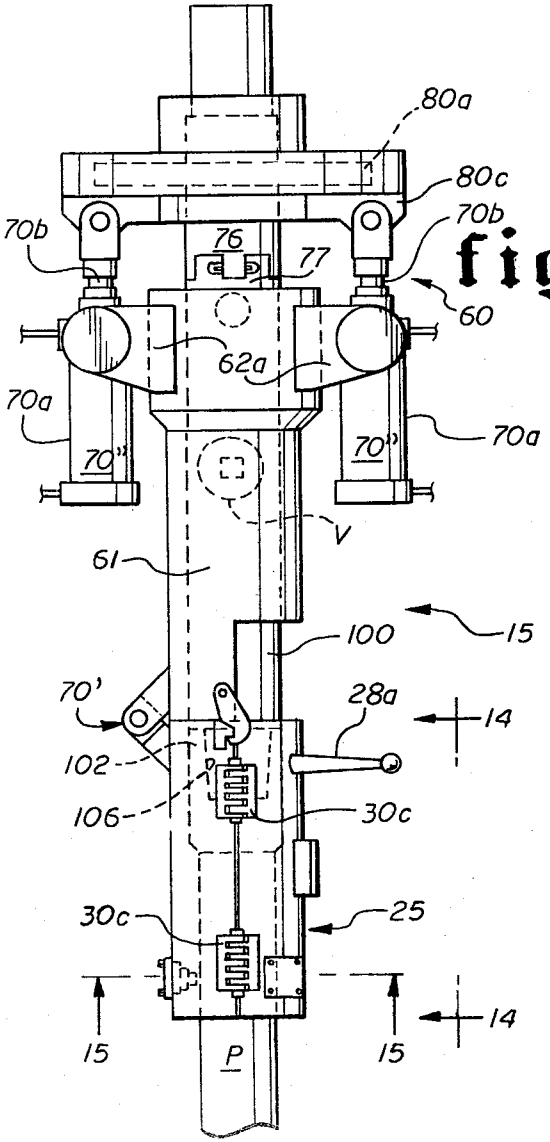
FIG. 13 is a side view similar to FIG. 12 and showing the final position of the components after the safety valve sub has been connected into the tubular member.

The second means 60 includes a housing 61 which is pivotally connected by the pivot 70' to the first means 25 similar to that described with regard to the modification shown in FIGS. 1–6. As shown in FIG. 13, the housing 61 includes support means 62*a* for each of the pair of double-acting power means referred to generally at 70" which may be of any suitable form and as illustrated include diametrically opposed double-acting cylinders at 70*a* with a piston (not shown) therein connected to a piston rod 70*b*, which piston rods 70*b* are connected at their upper ends to the housing 80*c* which supports rotatable means 80 as shown. This arrangement provides a means for moving, that is raising and lowering, the rotatable means 80 relative to the pipe P, if desired, to accommodate longitudinal movement of the safety valve sub 100 as it is threadedly connected with the box end 102 on the upper end of pipe P or for any other reason.

Figure 8:
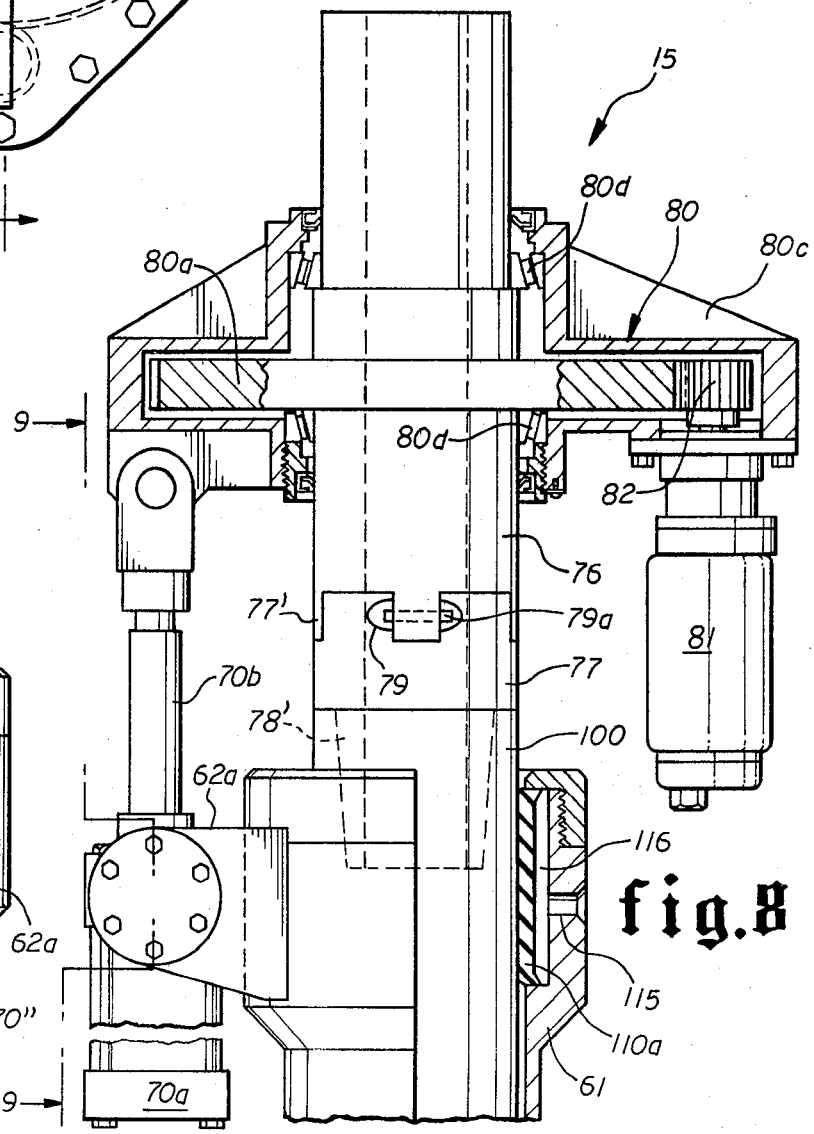
FIG. 8 is a one-quarter view, partly in section on the line 8—8 of FIG. 7.
Figure 11:
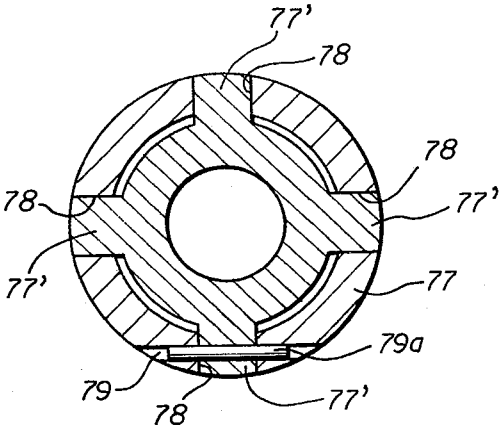
FIG. 11 is a section view on the line 11—11 of FIG. 10 illustrating an alternate form of retaining means for the safety valve sub.

A suitable air or hydraulic motor 81 is secured to and depends from housing 80*c* as shown in FIG. 8. Gear 82, similar to that described with regard to FIGS. 1–6 is provided on the shaft of motor 81 for imparting rotation to the rotatable means 80 which is shown as including ring gear means 80*a* within housing 80*c* as illustrated in FIG. 8. Secured to the ring gear 80*a* and depending axially therefrom is the adapter 76 forming part of sub 100 for connecting the safety valve sub 100 with the rotatable means 80. Suitable bearing means 80*d* between housing 80*c* and sub 100 accommodate relative rotation between housing 80*c* ring gear 80*a* and the sub 100 with which the ring gear is connected. The adapter may assume any suitable configuration and, as illustrated, it includes an annular member having circumferentially spaced projections 77' which fit in the recesses 78 of the lower portion 77 of the adapter 76 as better seen in FIG. 11. The lower adapter portion 77 is threadedly engaged with what may be referred to as the upper end of the safety valve sub 100 as shown at 78' in FIG. 8 of the drawings. The lower adapter portion 77 is provided with a hole 79 extending therethrough as shown in FIG. 11 for receiving a shear pin 79*a*. A projection 77' is provided with a hole to align with hole 79 to enable shear pin 79*a* to extend therethrough. This connects the upper and lower adapter means 76, 77 together, as shown in FIG. 11, and provides an arrangement for coupling the ring gear 80*a* to rotate the entire safety valve sub 100, and also enables the embodiment of the well tool 25 as shown in FIGS. 7–16 to be disconnected from the safety valve sub 100 after it has been threadedly engaged with the pipe P.

If desired, an alternate adapter arrangement may be employed. In such event, adapter 76 is interconnected with lower adapter portion 77 by projections 77' fitting in spaced recesses 78 as previously described so as to enable rotation to be imparted to sub 100 by ring gear means 80*a*. However, the connection between 76 and 77 by pin 79*a* is omitted so that the entire unit may be quickly lifted off the pipe P and sub 100. In FIG. 8 a plastic or elastomeric bladder or seal 110*a* is shown as secured in housing 61 and surrounds sub 100. Port means 115 in housing 61 are provided for connection with a hydraulic or pneumatic source for supplying inflation fluid to chamber 116 surrounding seal 110*a*. This causes bladder or membrane 110*a* to grip the sub 100 and hold it in the same manner as above-described with regard to the shear pin embodiment to retain and position sub 100.

If it is desired to remove this embodiment from the pipe P and sub 100, pressure is released from chamber 116 through port 115 to disengage seal 110*a* from sub 100; latch 31 is released to disengage arcuate members 28*c*, 28*d* and 28*e* from pipe P and the entire device may then be lifted off.

If desired, either the shear pin 79*a* form or the bladder 110*a* form may be employed as retaining means for sub 100. Safety valve sub 100 may be lowered or raised by the power means 70" when seal 110 is inflated to grip thereagainst.

Figure 10:
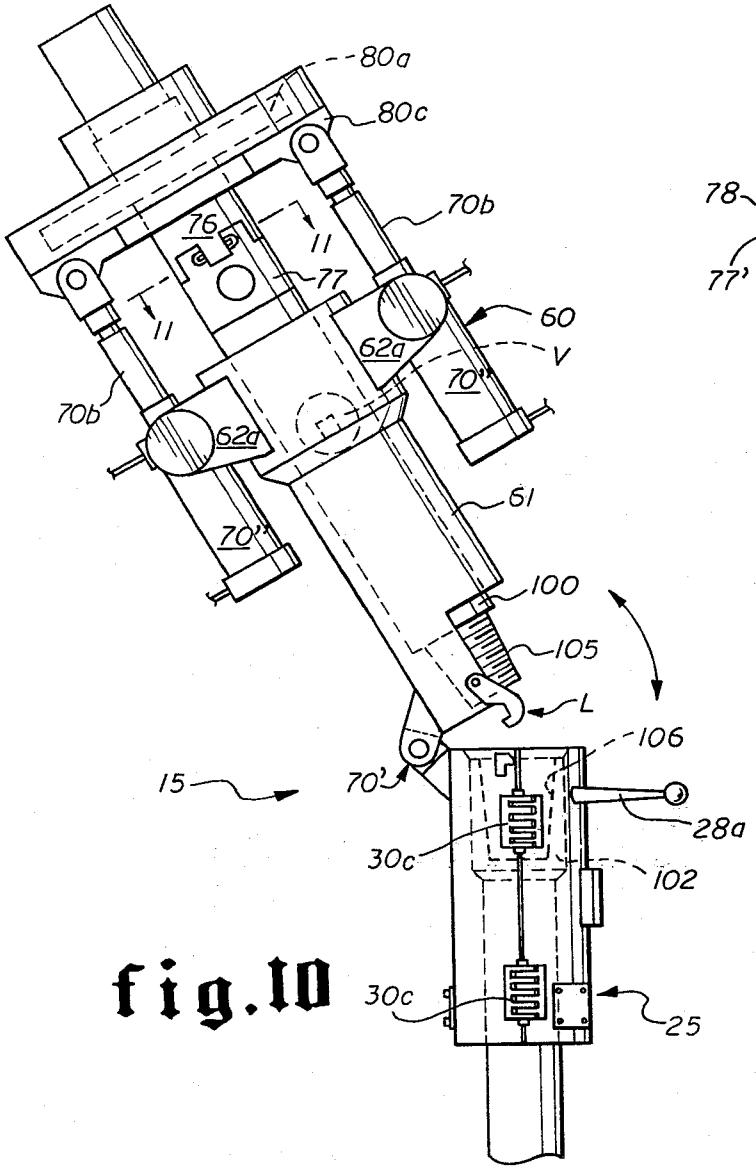
FIG. 10 is a side view of a preferred embodiment of the well tool.

It can be appreciated that the adapter arrangements above described between the ring gear 80*a* and the safety valve sub 100 also function as a retaining means to retain the safety valve sub 100 in position in the housing 61 as the housing 61 is manually moved from the position shown in FIG. 10 to the axially aligned position as shown in FIG. 13 with the first means 25. It can also be seen that the second means 60 of the FIGS. 7–16 modification provides means to support the rotatable means 80 for rotation as well as means to support the rotatable means 80 for movement longitudinally. More particularly, the power means 70" provides a means to support the rotatable means 80 on the second means, and depending upon the direction of fluid flow to the cylinders 70*a*, the rotatable means may be moved longitudinally in either direction relative to the pipe P.

In operation of this form of the invention, it is manually moved from its support at one side of the drilling mast D, and positioned relative to the pipe P by manipulating the cables 16. To position the present invention about the pipe P, the arms or levers 28*a* are manually grasped in a manner well known in the art and the arcuate portions 28*c*, 28*d* and 28*e* moved from a position surrounding the pipe P to a closed and engaged position with the pipe P. The arcuate portions 28*c*, 28*d* and 28*e* are thus clamped by the clamp 31 adjacent the upper end of the pipe P. The upper end of the pipe P is a box end which includes threads 106 therein to enable a tubular member to be stabbed thereinto and threadedly connected therewith.

Figure 12:
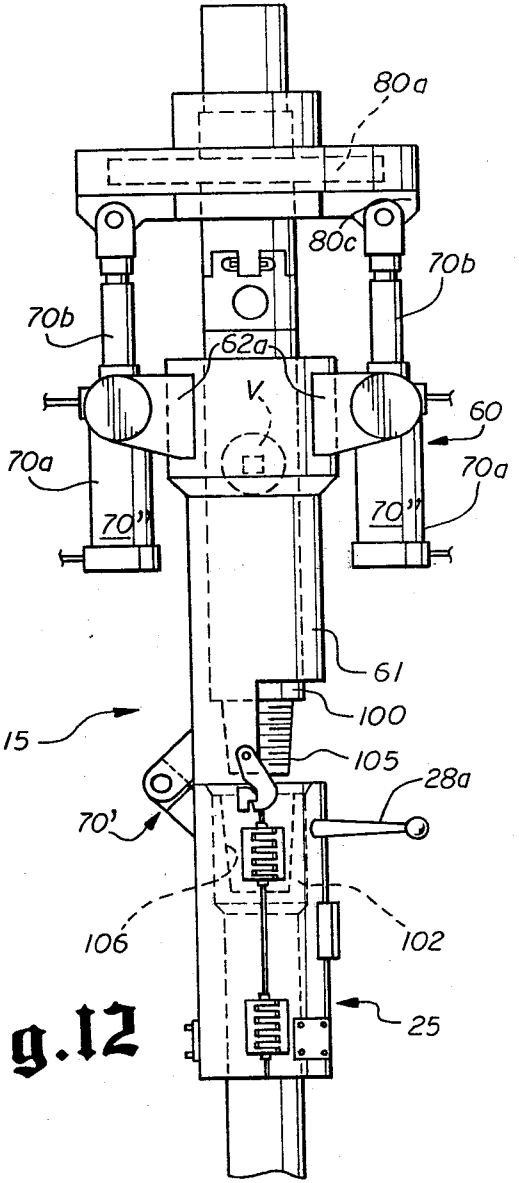
FIG. 12 is a side view of the device shown in FIG. 10 and illustrating the relationship of the components when the safety valve sub is in position to be connected into the upstanding well string.

After the first means 25 has been positioned on the pipe P, the second or support means 60 may then be moved from the inactive position of FIG. 1 or the inactive position of FIG. 10 to axially aligned position with the first means 25, such axially aligned position being illustrated in FIGS. 2 and 12, respectively. During such movement, the retaining means in the form of the shear pins 64 in FIG. 5 or the bladder of FIG. 8 or the pin 79*a* in FIG. 11 retain the safety valve sub 100 in position in its respective support means 60 and prevents downward movement thereof so as to properly position it in alignment with the box end 102. When the first means 25 and second means are aligned latch L engages and retains them in position.

Upon rotation of the ring gear 80*a* by the motor 81, the safety valve sub 100 is also rotated so that it threadedly engages with the threads 106 of the box end 102. It can be appreciated that in the FIGS. 1–6 form, shear pin 64 shears substantially immediately upon rotation of the ring gear 80 relative to the housing 61 so that downward movement of the kelly valve sub may thereafter occur as it threads with pipe P. In the FIGS. 7–16 modification, the power means 70″ may be actuated so as to lower the housing 80*c* and supported rotatable means 80 until the threads 105 engage with the threads 106 whereupon rotation of the ring gear means 80*a* effects connection of the safety valve sub with the pipe P as shown in FIGS. 3 and 13 of the drawings, respectively. In both forms, longitudinal movement of the safety valve sub 100 is accommodated to enable the threaded connection to be affected. The power means 34 in FIG. 1 or 70″ in FIG. 13 may assist in such movement, or may be deactivated so as not to interfere with such longitudinal movement.

Before disengaging the safety valve sub launching arrangement of the present invention from the pipe P and sub 100, it may be desirable to use tongs to assure proper make-up of the sub 100 with pipe P. In such event, the tongs may be engaged with the sub 100 above ring gear means 80*a* in the FIGS. 1–6 form, whereas in the FIGS. 7–15 form the upper end of adapter 76 projecting above housing means 80*c* may be engaged by the tongs to rotate sub 100 and assure that threads 105 and 106 are completely and properly engaged.

Thereafter, the launching device of the present invention may be disengaged from the safety valve sub 100 by manually opening the latch 31 shown in FIGS. 6 and 15 whereupon the semicircular members or jaws 28 and 29 or arcuate portions 28*c*, 28*d* and 28*e* may be opened to disengage from the pipe P. The FIG. 1–6 form of the invention may be removed from the sub by moving the key 80*c* along the groove 100*c* until the device is removed. The embodiment of FIGS. 7–15 may be removed by shearing or disengaging the pin 79*a* from the opening 79 so that the device can be lifted off the safety valve sub 100. The lower adapter 77 may be removed by engaging suitable means such as tongs or the like adjacent the upper end of the safety valve sub 100 and also on the lower portion 77 of the adapter to unthread the adapter 77 from the safety valve sub. Where the bladder 110*a* is employed, it must be permitted to collapse and disengage from safety valve sub 100 to enable the device to be lifted off as previously described.

When desired, the safety valve V in the sub 100 may be manually rotated by any suitable means such as a wrench or the like to close off the opening in the safety valve sub and thus close off flow or access through the interior of the pipe P.

The device is shown as preferably having two motors 81 and two power sources 70″ to accomplish the desired movement, longitudinal and rotational.

The foregoing disclosure and description of the invention are illustrative and explanatory thereof, and various changes in the size, shape and materials, as well as in the details of the illustrated construction may be made without departing from the spirit of the invention.

What is claimed is:

1. In a well tool adapted to be supported out of the way during well bore operations, but movable to adjacent an upwardly extending tubular well bore member for connecting a sub carried by the well tool to the upper end of the tubular member, the invention comprising:

a. releasable means engageable about the upwardly extending tubular member to releasably secure the well tool in position adjacent the end thereof;

b. additional means pivotally connected with said releasable means, said additional means including support means for the sub and rotatable means for rotating the supported sub to threadedly connect it with the tubular member;

c. means to secure said releasable and additional means in axial alignment while threadedly connecting the sub with the tubular member; and d. means to move said rotatable means and supported sub longitudinally relative to said releasable means when said releasable means is engaged about the tubular member to threadedly engage the sub with the tubular member.

2. The well tool of claim 1 including releasable retaining means to releasably connect the sub with said rotatable means during longitudinal and rotational movement thereof, whereby the well tool may be removed from the sub and tubular member after connecting the sub with the tubular member.

3. The well tool of claim 1 wherein said rotatable means includes:

a. ring gear means rotatably carried by said additional means;

b. coupling means to couple said ring gear means with the sub for rotation thereof; and c. means to rotate said ring gear means.

4. The well tool of claim 3 wherein:

a. said releasable means includes hingedly connected members with latch means thereon whereby said releasable means may be releasably engaged with the upwardly extending threaded tubular member; and b. said coupling means is releasably engaged with said ring gear means and the sub whereby said releasable and additional means may be removed from the sub after it is threadedly connected with the upstanding tubular member.

5. The well tool of claim 1 wherein said additional means includes:

a. an annular housing having a central opening for receiving the sub;

b. ring gear means carried by said housing and having a central opening for receiving the sub; and c. bearing means between said housing and ring gear to accommodate relative rotation therebetween.

6. The well tool of claim 3 wherein said additional means includes:

a. an annular housing supporting said ring gear means and having a central opening therethrough for receiving the sub;

b. means to accommodate relative rotation between said housing and said ring gear means; and wherein said coupling means includes:

c. drive key means on said ring gear and projecting into the ring gear central opening; and d. longitudinal key way means on the sub to receive said drive key means therein.

7. The well tool of claim 1 wherein said rotatable means include:

a. ring gear means rotatably carried by said additional means and having a central opening therethrough to receive the safety valve sub; and b. retaining means to releasably connect the sub with said rotatable means during longitudinal and rotational movement thereof.

8. The well tool of claim 7 wherein said retaining means includes connecting means for releasably connecting the sub to said rotational means whereby the rotatable means and sub may be disengaged from each other after the sub is threadedly engaged with the tubular member.

9. The well tool of claim 8 wherein said second means includes means to support said rotatable means for rotation and means to support said rotatable means for movement longitudinally of said second means.

10. The well tool of claim 3 wherein said coupling means includes:

a. adapter means threadedly engaged with the safety valve sub;

b. coupling means connected to said ring gear and engageable with said adapter means; and c. means to releasably connect said adapter to said coupling means.

11. In a well tool adapted to be supported out of the way during well bore operations, but movable to adjacent an upwardly extending tubular well bore member for connecting a sub carried by the well tool to the upper end of the tubular member, the invention comprising:

a. releasable means to engage the upwardly extending tubular member to relasably secure the well tool in position adjacent the end thereof;

b. support means connected with said releasable means and including rotatable means to rotate the sub to connect it with the upwardly extending tubular member;

c. means to maintain said support means and releasable means in axial alignment on the tubular member as the sub is threadedly connected with the tubular member;

d. means to move said rotatable means and supported sub longitudinally relative to said releasable means when said releasable means is engaged about the tubular member as the sub is threadedly connected to the tubular member; and e. releasable retaining means to releasably connect the sub with said rotatable means during longitudinal and rotational movement thereof and disengageable from the sub for removal of the well tool.

* * * * *